United States Patent [19]

Wright et al.

[11] 4,025,884

[45] May 24, 1977

[54] RELAY CONSTRUCTION

[75] Inventors: William Warren Wright, Wheaton; John J. Rowell, Glenview; Edgar P. Canty, Elmhurst, all of Ill.

[73] Assignee: Guardian Electric Manufacturing Company, Chicago, Ill.

[22] Filed: Oct. 16, 1975

[21] Appl. No.: 622,887

[52] U.S. Cl. ..... 335/129; 335/270

[51] Int. Cl.[2] ..... H01H 67/02

[58] Field of Search ..... 335/128, 127, 129, 125, 335/121, 202, 270, 276

[56] References Cited

UNITED STATES PATENTS

| | | | |
|---|---|---|---|
| 3,158,712 | 11/1964 | Defugue | 335/276 X |
| 3,273,087 | 9/1966 | Huckabee | 335/128 |

*Primary Examiner*—George Harris

*Attorney, Agent, or Firm*—Allegretti, Newitt, Witcoff & McAndrews

[57] ABSTRACT

An improved relay includes a bobbin or spool having dual flanges at each end which include slots for receipt of one leg of an L-shaped armature and core piece. The coil and bobbin assembly including the armature are mounted in a housing on contact pins molded in the base of the housing. An integral armature spring and moving blade contact is also mounted in the housing attached to the armature. One leg of the armature extends along the outside length of the coil and cooperates with a core piece within the spool to complete a magnetic circuit. Upon movement of the armature, the connected moving blade contact provides a wiping action of the movable contact against stationary contact pins thereby effecting efficient making and breaking of a circuit.

11 Claims, 13 Drawing Figures

54
71
26
56
70
52
62
50
58
68
64
60
55
66
53

59
77
7
73
57
72
76
8
92
75
74
90
93
82
84
91
86
80
61
8
7

73
50
75
57
62

72
53
76
90
74
58
64
62
91
68
66

34
10
32
10
36

32
34
36
37

49
48
51
41
40
43
44
42
46

RELAY CONSTRUCTION

BACKGROUND OF THE INVENTION

This invention relates to a relay construction and, more particularly, to an improved coil spool assembly and armature construction for a relay, particularly a relay having one or more poles associated with its moving contact.

With the advent of transistors and now integrated miniature circuits, it has been necessary to attempt to miniaturize relays operated by these circuits. Such relays must be compatible with circuit boards of the type used for modern circuitry. Additionally, however, such relays must be capable of withstanding and switching high loads and currents. Moreover, such relays should be of simple construction having a minimum number of manufacturing operations, minimum internal soldering and should eliminate the need for subsequent soldering operations. Temperature and flux contaminations as well as flux removal techniques normally employed on modern printed circuit boards dictate against extensive soldering operations for miniature relay manufacture. Simplicity of construction, reliability of function, resistance to environmental contaminants, small physical size and good thermal resistance to relatively high temperatures are very important characteristics which must be designed into such a relay. Such relays should have rigid construction to prevent any significant shift of component parts during insertion of relay as a component of another assembly. Additionally, such relays should have few riveting and forming operations associated therewith to enhance their repairability and fabricability.

SUMMARY OF THE INVENTION

Briefly, the subject matter of the present invention comprises an improved relay construction which includes a spool for receiving a coil as well as a unique end flange construction for the spool for cooperation with an L-shaped armature and core piece. The armature has one leg which is inserted into a slot defined in the spool end flanges. Pivotal action of the armature is effected by passage of current through a coil wound on the spool. An integral biasing spring and contact blade is attached to the armature and upon movement thereof provides improved wiping action against stationary contacts associated with the relay.

It is thus an object of the present invention to provide an improved relay and, in particular, an improved miniature relay construction.

Still another object of the present invention is to provide an improved relay to the type having one or two poles associated with a moving armature and attached contact blade.

Another object of the present invention is to provide an improved relay wherein the unique L-shaped armature cooperates with a molded plastic spool for the coil.

Another object of the present invention is to provide a relay construction wherein an integral moving contact blade and spring for the armature is utilized to promote maximum wiping action between the moving contact and fixed contacts of the relay.

Another object of the present invention is to provide a miniature relay of simple and economic construction.

These and other objects, advantages and features of the present invention will be set forth in the detailed description which follows.

BRIEF DESCRIPTION OF THE DRAWING

In the detailed descriptin which follows, reference will be made to the drawing comprised of the following figures.

DESCRIPTION OF THE PREFERRED EMBODIMENT

General Assembly

Referring to the Figures, the improved relay construction of the present invention includes a housing 10 having a base 12 and an upstanding circumferential side flange 14. The housing 10 is fabricated from a non-conductive thermoset material such as molded polyester, diallyphthalate or other type of plastic.

The entire assembly or relay construction is maintained within a cover 11 which cooperates with the housing 10. The cover 11 is preferably made from a material similar to or identical with the material forming the housing 10.

Figure 3:
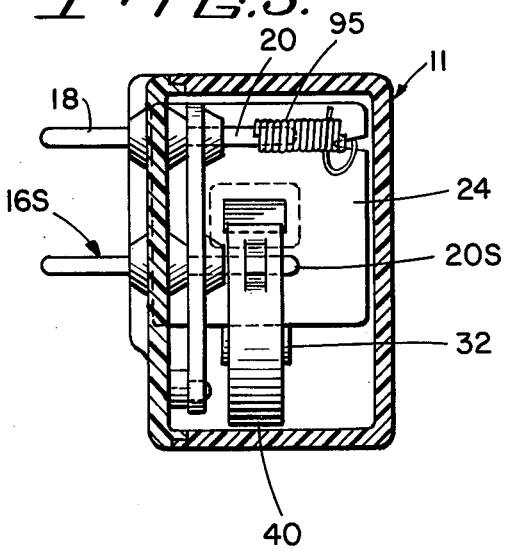
FIG. 3 is another cross-sectional view of the relay of FIG. 1 taken substantially along the line 3—3.
Figure 4:
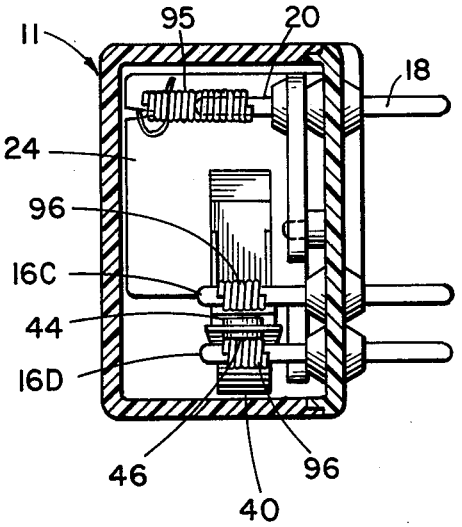
FIG. 4 is a cross-sectional view of the relay construction of FIG. 1 taken along the line 4—4.

Integrally molded within the base 12 of the housing 10 are a plurality of contact pin members 16. The contact pin members 16 have an outside pin end 18, an inside pin end 20 as shown in FIGS. 3 and 4 and an intermediate connecting section (not shown). The pin members 16 are made from a conductive material to provide an electrical path through the housing 10. The pin members 16 are arranged in a particular array as illustrated in order that they may serve a multiplicity of functions including: (1) positioning and holding the coil assembly, (2) providing terminals for connection with coil leads, (3) providing terminals for relay switch contact, and (4) providing a pivot mounting for the armature spring for the relay construction. These terminal pins serve the additional function of anchoring pilots and supports for the other parts of the relay assembly within the base. These features are described in more detail below.

A coil assembly 22 includes a spool or bobbin 24 having a wound coil 26. An L-shaped core piece 28 is inserted into the spool 24 and includes a center leg 29 and a short leg 30 at one end of coil 26. The core piece 28 is fabricated from a magnetically conductive material.

An armature 32 having a short leg 34 and an extended leg 36 is also positioned in cooperation with spool 24. Thus, short leg 34 fits within a slot 38 defined in the bobbin 24. Extended leg 36 extends substantially parallel to center leg 29 of core piece 28 and completes a magnetic circuit through short leg 30 of the core piece 28. An integral spring and moving contact blade 40 includes a first run 42 attached to extended leg 36 of the armature. The opposite end of blade 40 is attached to a pin 16S. Contact rivets 44 and 46 are attached to the end of the first run 42, and cooperate with pins 16C and 16D.

Bobbin Structure

Referring to FIGS. 5 through 8 as well as FIGS. 1 through 4, the structure of the bobbin 24 is illustrated in greater detail. The bobbin 24 includes a hollow core center portion 50 with a passage 62 extending the entire length of the bobbin 24. Coil 26 is wound about the core portion 50. Integrally molded dual flange portions or sections 52 and 54 are provided at each end of the center portion 50 for retaining the coil 26.

Dual flange portion 52 includes an end flange 56 and a spaced secondary flange 58. The flanges 56 and 58 are separated by slots 60 and 70. Radial slot 60 connects with passage 62 of core portion 50. The secondary flange 58 also includes a radial opening 64 extending from passage 62. Opening 64 has opposed barbs or tabs 66 and 68. Thus, (in FIG. 1) center leg 29 of L-shaped core piece 28 of soft iron or similar magnetically conductive material may be inserted into the hollow core passage 62 with the short leg 30 passing through opening 64 and being retained within radial slot 60 by tabs 66 and 68 of opening 64. Assembly of core piece 28 therefore is easily undertaken by means of a simple operation which causes the core piece 28 to be restrained in position in the spool 24 without any additional holding means of fastening means other than tabs 66 and 68. Because the bobbin 24 is made from a partially elastic material, the tabs 66 and 68 snap into position against the core piece 28 to hold it locked within bobbin 24.

Flanges 56 and 58 also define a top slot 70 therebetween. Intermediate flange slits 72 and 74 are provided in flange 56 and flange slit 76 is provided in secondary flange 58. It is to be noted that flange slit 74 is cut more deeply into the end flange 56 than slit 72 since slit 74 is for receipt of an initial lead wound upon center portion 50. Slit 72 does not extend as deeply into the flange 56 since slit 72 is for receipt of the end lead of a coil 26 already wound upon center portion 50.

Slits 72, 74 are V-shaped to provide a wedge locking action in cooperation with a lead wire 27A. The slit 72, slot 70 and slit 76 thus receives lead wire 27A from coil 26. The offset positioning and shape of the slits 72, 74 and 76 as well as the utilization of top slot 70 provides for a mechanical locking of the lead 27A by the cooperative action of the slits thereby preventing unraveling of coil 26.

Figure 1:
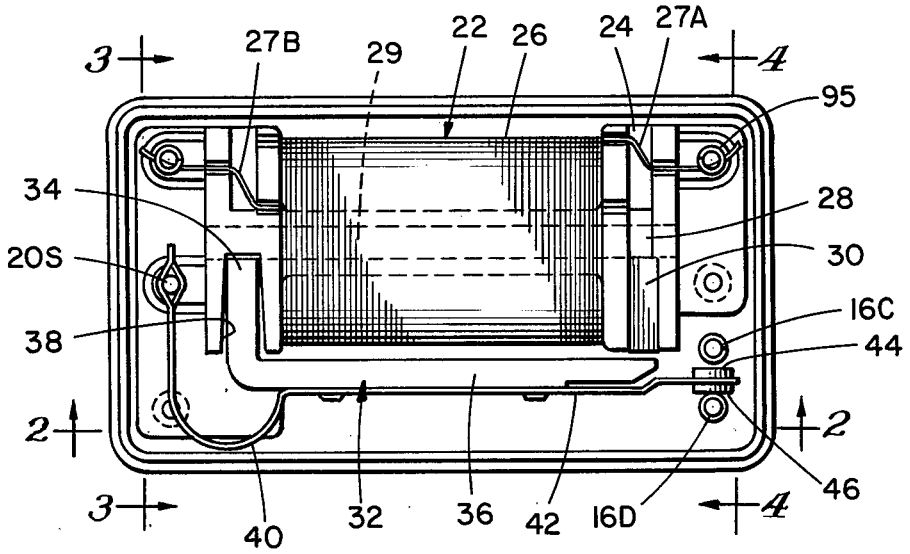
FIG. 1 is a top plan view of one embodiment of the improved relay of the present invention having a single pole double throw configuration.

The opposite flange portion 54 is of similar construction. Thus, flange portion 54 includes end flange 57, secondary flange 59, end V-shaped flange slits 73 and 75 and secondary V-shaped flange slit 77. The beginning lead 27B of coil 26 passes through slit 77 and slit 75 as shown in FIG. 1. Flanges 57 and 59 define a radial slot 61 and a top slot 71 corresponding respectively to slot 60 and slot 70 in flange portion 52. Note that the symmetrical positioning of slits 72—77 permits appropriate positioning of coil leads and winding of a coil on portion 50 in the clockwise or counterclockwise sense.

An armature 32 with a short leg 34 and extended leg 36 cooperates with slot 61. Short leg 34 is in the form of a rectangular parallelepiped. The slot 61 does not have such a shape. Rather, the slot 61 has a truncated shape. Thus, slot 61 includes a wide front opening 80, narrow back side and opposed slanted surfaces 84 and 86. The surfaces 84 and 86, if extended, would intersect to form an acute angle. Surfaces 84 and 86 define the limits of rotation of the leg 34 and thus the armature 32. Slot 61 intersects hollow core 62 so that leg 34 of armature 32 may make physical contact wiht core piece 28 to thereby effect a closed magnetic circuit through the armature 32 and core piece 28.

Incorporated as an integral portion of the dual flange portions 52 and 54 are attachment extensions 53 and 55, respectively. Each extension 53 and 55 includes pin openings as at 90–93. The pin openings 90, 92 and 93 fit over pin members 16 as illustrated in FIGS. 1 through 4. Note in FIGS. 3 and 4 that coil springs 95 are positioned on inner pin end 20 of pins 16 to assist maintenance of the bobbin 24 on base 12. The coil springs 95 are made of a conductive material, fit over pin ends 20 and provide a means for contacting and/or connecting a lead wire to the pins 16 as shown in FIG. 4. Precious metal springs 96 are provided for engagement of the pins 16C and 16D as a means for making electrical contact with rivets 44 and 46 as shown in FIGS. 1 and 4.

Armature Construction

Figures 5, 6, 7, 8, 9, 10, 11:
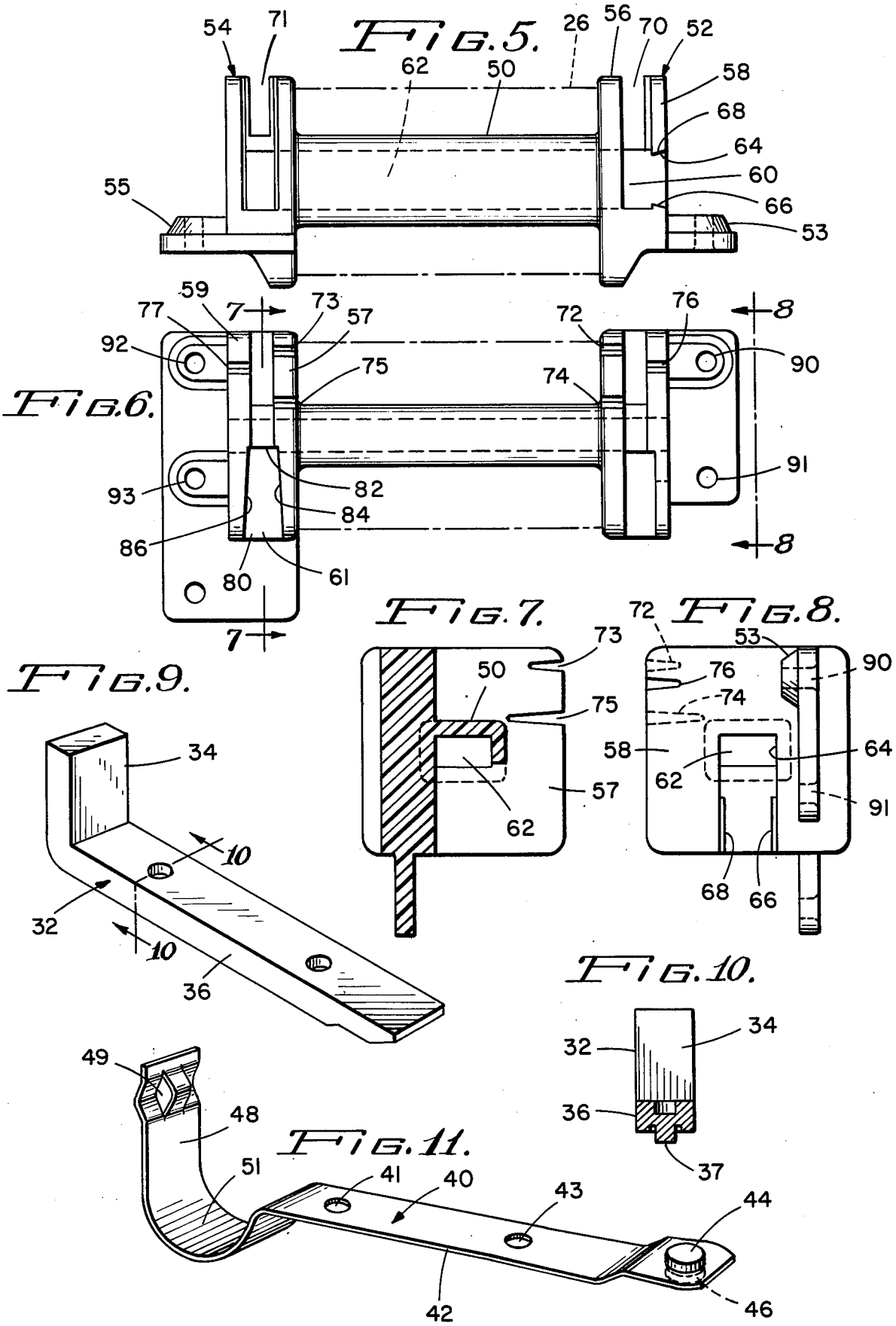
FIG. 5 is an enlarged elevational view of the coil bobbin for the relay of the present invention.
FIG. 6 is a plan view of the coil bobbin shown in FIG. 5.
FIG. 7 is a cross-sectional view of the coil bobbin taken along the line 7—7 in FIG. 6.
FIG. 8 is an end view of the bobbin in FIG. 6 taken substantially along the line 8—8.
FIG. 9 is an enlarged perspective view of the armature used in the relay construction of the present invention.
FIG. 10 is a cross-sectional view of the armature of FIG. 9 taken substantially along the line 10—10.
FIG. 11 is an enlarged perspective view of the integral spring and moving contact blade utilized with the relay of the present invention.

FIGS. 9 and 10 illustrate the construction of the armature 32. The armature 32 includes a short leg 34 and an extended leg 36. The legs 34, 36 join together in an L shape. The armature 32 is made from a magnetically conductive material. A projection 37 is formed on the extended leg 36 of the armature 32. Projection 37 cooperates with an opening 41 in blade 40. A second opening 43 receives a fastener to attach blade 40 to the armature 32. The extended leg 36 of the armature 32 is of a size to extend the length of coil 26. In this manner, the extended leg 36 provides a path for magnetic conduction from one end of core piece 28 to the opposite end thereof whenever the armature 32 is moved in the counterclockwise direction as illustrated in FIG. 1 due to passage of current through coil 26. Thus, the armature 32 makes a physical and magnetic path between the opposite ends of core piece 28.

Blade Construction

Figure 2:
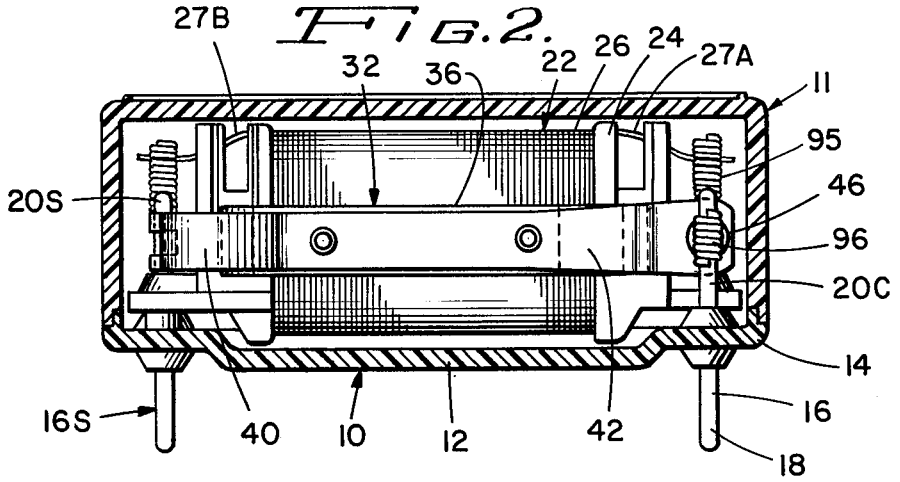
FIG. 2 is a cross-sectional view of the relay of FIG. 1 taken substantially along the line 2—2.

The blade 40 includes a first run 42 which is attached to the armature 32 as described above. The contact rivets 44 and 46 are attached to the end of the run 42. A curved second leg 48 terminates with a slit opening 49. The opening 49 fits pin end 20S as illustrated in FIGS. 1-3, and as further described in application Ser. No. 539,772, Mally, filed Jan. 9, 1975, "Blade Construction for Relay", now U.S. Pat. No. 3,958,200, which is incorporated herewith by reference.

The second leg 48 is accurately curved so that the end portion of the leg 48 remains substantially parallel to the short leg 34 of armature 32. Importantly, curved portion 51 of the blade 40 provides a spring action to the armature 32 tending to rotate the armature 32 in a clockwise direction as viewed in FIG. 1.

Operation

In operation, current passes through the coil leads 27A and 27B and coil 26. This causes the armature 32 to move thereby breaking contact 46 from its spring 96 associated with pin 16D. The blade 42 is translated toward the opposite contact pin 16C and rivet 44 engages the associated spring 96 in a wiping action thereby making a circuit. Spring 96 as well as the other springs 95 attached to pins 16 are described in greater detail in application Ser. No. 622,888, filed Oct. 16, 1975, W. Warren Wright, "Improved Contact Construction for Relays, " which is incorporated herewith by reference.

Note that the contact making and breaking occurs with a wiping action inasmuch as the armature 32 is L-shaped and tends to pivot in slot 61 thereby translating blade 42 in both a rotational sense and a lateral sense because of the dimension of the short leg 34.

Figure 12:
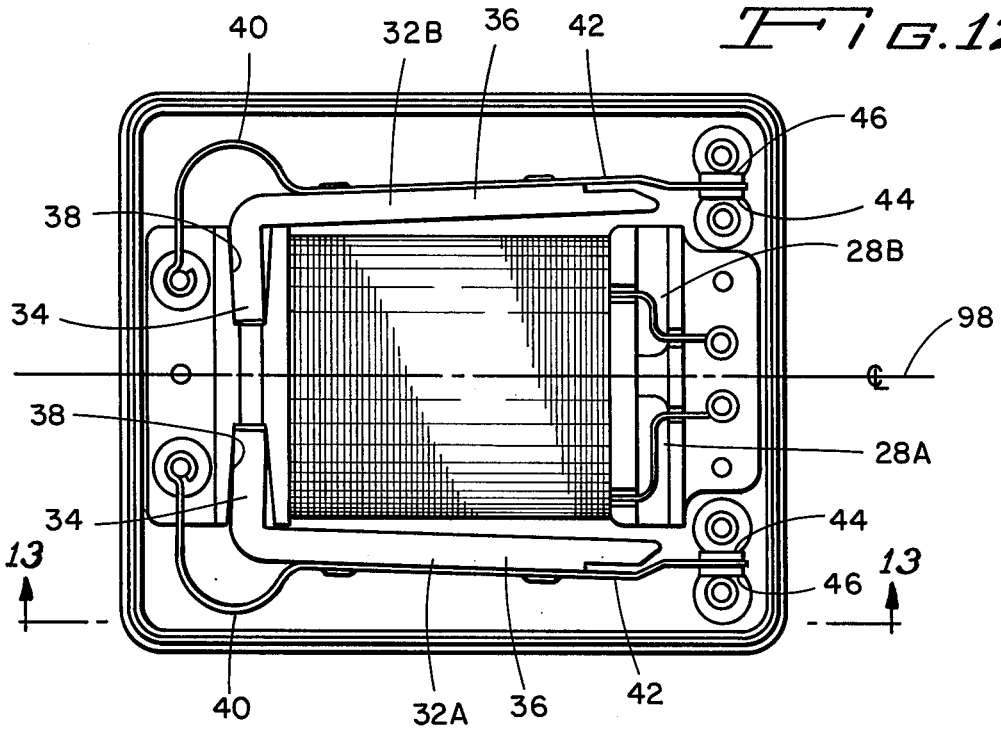
FIG. 12 is a plan view of a second embodiment of the relay of the present invention.
Figure 13:
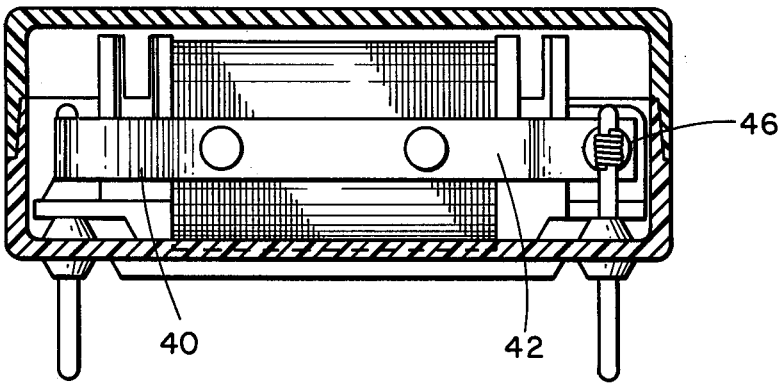
FIG. 13 is a cross-sectional view of the relay of FIG. 12 taken substantially along the line 13—13.

The relay described and illustrated constitutes a single-pole, double-throw switch. FIGS. 12 and 13 illustrate an arrangement wherein a double-pole, double-throw switch is provided. With the double-pole, double-throw construction, the bobbin is fashioned so that two core pieces 28A and 28B are provided. Similarly, two armatures 32A and 32B are provided. In fact, the structure of the double-pole, double-throw relay as illustrated in FIGS. 12 and 13 is such that the structure on opposite sides of center line 96 is a mirror image. The structure beneath the center line 96 in FIG. 12 is substantially identical to the structure described in FIGS) 1 through 8. The only difference is that the coil is wrapped entirely around both core pieces 28A and 28B.

FIGS. 12 and 13 illustrate merely one alternative construction. For example, the armatures 32A and 32B may be reversed in direction to provide another alternate construction. Also, the bobbin may be molded to receive additional armatures. Thus, the bobbin may be molded for receipt of armature at numerous positions about the circumference of the bobbin. Other alternatives will be apparent to those skilled in the art.

Therefore, while there has been set forth a preferred embodiment of the invention, it is to be understood that the invention shall be limited only by the following claims and their equivalents.

What is claimed is:

1. An improved coil assembly and armature construction for a relay having one or more poles comprising, in combination:

a spool for receiving a coil, said spool being made from a non-conductive material and having a reduced cross-section center portion receiving a coil, opposed end flanges for retaining the coil, a hollow core for receipt of a magnetically conductive core field piece, and first and second secondary flanges spaced respectively from the end flanges, one pair of associated flanges defining a slot for receipt of at least part of the magnetically conductive core piece and the other pair of flanges defining a slot for receipt of part of an armature;

an L-shaped armature projecting in part into one of said slots and extending the length of the center section to the other slot;

integral spring means and moving contact blade means attached to the armature and biasing the armature against magnetic force resultant from current through the coil; and contact means for cooperation with said moving contact blade means.

2. The improved construction of claim 1 including an additional core piece of magnetically conductive material in said other slot to define a closed magnetic loop through said armature and conductive core pieces.

3. The improved construction of claim 2 wherein said core piece is an integral L-shaped member fitted simultaneously in said slots.

4. The improved construction of claim 1 wherein said spool also includes integral mounting extension means molded with said flanges.

5. The improved construction of claim 4 including a housing for said construction, said housing including a plurality of contact pins projecting from the base thereof, said molded bracket means cooperative with said pins for maintaining said spool in a substantially fixed position within said housing.

6. The improved construction of claim 1 including slots through said first and second end flanges for receiving a lead wire from a coil on said spool, said spool also including a single slot through the secondary flanges for receiving said leads, said leads being inserted through one of the slots on said end flanges and the slot on said secondary flanges to be thereby retained in fixed, locked position.

7. The improved construction of claim 1 including mounting means for said spool, and first and second contact pins mounted for cooperation with the moving blade contact means, of one the pins mounted for electrical contact with said moving contact blade means whenever the armature is moved in response to current in the coil and the other of the contact means positioned for engagement by the moving contact blade means in the absence of current in the coil, said blade means moving into engagement with the fixed pins with a wiping action.

8. The improved construction of claim 1 including a housing for mounting the spool and other components of the relay and a cover for enclosing and cooperating with said housing.

9. The improved construction of claim 1 including a plurality of slots defined by the end flanges and the related secondary flange, a plurality of L-shaped armatures, each one of said armatures projecting in part into one of said slots and extending in part along the length of the coil to thereby define a plurality of moving blade contact means forrelay action.

10. The improved construction of claim 1 wherein the slot for receipt of said armature includes opposed walls defined by an end flange and one secondary flange, said opposed walls forming an angle with each other and with said surfaces of the armature, said angle being an acute angle whereby the pivotal motion of said armature is limited by interaction with the opposing side walls of said slot.

11. The improved relay construction of claim 1 wherein said integral spring means and contact blade means comprise a blade having a first run parallel to and attached to one leg of the armature and a second run parallel to but sapced from the other leg of the armature with an interconnecting spring tension, U-shaped section having an apex generally aligned with the point of intersection between the legs of the L-shaped armature and having its one end affixed in spaced parallel relation to the pivot point of the armature in the slot and the opposite end thereof including contact means for cooperation with fixed contact means.

* * * * *